US006766134B2

(12) United States Patent
Nakamura

(10) Patent No.: US 6,766,134 B2
(45) Date of Patent: Jul. 20, 2004

(54) PHOTOCOPIER AND MULTIFUNCTION PRINTER

(75) Inventor: Masashi Nakamura, Tokyo (JP)

(73) Assignee: Panasonic Communications Co., Ltd., Fukuoka (JP)

( * ) Notice: Subject to any disclaimer, the term of this patent is extended or adjusted under 35 U.S.C. 154(b) by 0 days.

(21) Appl. No.: 10/327,047

(22) Filed: Dec. 24, 2002

(65) Prior Publication Data

US 2003/0156860 A1 Aug. 21, 2003

(30) Foreign Application Priority Data

Feb. 19, 2002 (JP) ..... 2002-041384

(51) Int. Cl.[7] ..... G03G 15/08
(52) U.S. Cl. ..... 399/258; 399/261; 399/262
(58) Field of Search ..... 399/252, 258, 399/261, 262; 222/DIG. 1

(56) References Cited

U.S. PATENT DOCUMENTS 5,528,349 A * 6/1996 Satake ..... 399/262
5,970,290 A * 10/1999 Yoshiki et al. ..... 399/261
6,259,877 B1 * 7/2001 Taniyama et al. ..... 399/262

* cited by examiner

*Primary Examiner*—Hoan Tran
(74) *Attorney, Agent, or Firm*—Greenblum & Bernstein, P.L.C.

(57) ABSTRACT

A photocopier includes a toner bottle that discharges toner from an opening by a rotation, a motor that rotates the toner bottle and a contacting section provided at a position through which a protrusion of the toner bottle passes when the protrusion comes down by the rotation of the toner bottle. When the weight of the toner bottle is more than or equal to a predetermined value, the contacting section descends by the weight of the toner bottle when the protrusion passes through the contacting section, and the contacting section ascend when the protrusion passes away from the contacting section. When the weight of the toner bottle is less than a predetermined value, the contacting section doesn't descend by the weight of the toner bottle.

6 Claims, 10 Drawing Sheets

Prior Art

PHOTOCOPIER AND MULTIFUNCTION PRINTER

BACKGROUND OF THE INVENTION

1. Field of the Invention

The invention relates to a photocopier and multifunction printer of a type able to record data using toner media supplied from a toner bottle.

2. Description of Related Art

In recent years, multifunction printers which includes both facsimile and printing functions have been introduced. Conventionally, toner replenishment is required in cases where photocopiers equipped with multifunction printers employ a toner-based photoelectric image recording method. Toner replenishment is conducted through a toner-containing bottle attached to the photocopier. When toner within the toner bottle is completely consumed, the depleted toner is replenished through the installation of a new bottle of toner.

The toner bottle incorporates an orifice at one extremity, and a spiral rib formed on the internal wall. Rotation of the toner bottle causes the spiral rib to transport toner to the extremity orifice from where toner falls into the printing apparatus to replenish the toner supply.

This conventional technology, however, exhibits the following shortcomings.

The length and weight of the toner bottle increase when the bottle is made larger for the purpose of holding a larger volume of toner. The increased length of the toner bottle, however, makes it more difficult to discharge all of the toner from the bottle.

As shown in the cross sectional view of toner bottle 1200 in FIG. 12, an attempt has been made to solve the problem by incorporating protruding shock rib 1201 on the external circumference of toner bottle 1200, and providing flange 1202 on the photocopier side to make opposing contact with shock rib 1201. The purpose of flange 1202 is to aid in the transport of toner within toner bottle 1200 by applying a shock to the toner bottle during each rotation.

This structure forces shock rib 1201 to ride up onto and over flange 1202 with each rotation of toner bottle 1200 with the result that toner bottle 1200 is pushed off of its rotational axis. While this eccentric rotation has no adverse effect at times when toner bottle 1200 is of relatively light weight, in cases where toner bottle 1200 is heavier, the action whereby shock rib rises on flange 1202 increases the load on the motor that powers the rotation of toner bottle 1200. This additional load can lead to, at worst, motor stoppage and/or breakdown of the drive mechanism.

SUMMARY OF THE INVENTION

The present invention addresses the shortcoming described above through a photocopier equipped with a multifunction printer that uses a toner bottle apparatus structured to minimize the amount of toner remaining in the bottle at depletion, to reduce the load applied to the motor that provides power for toner bottle rotation, and to prevent breakdown of the toner bottle drive mechanism, regardless of the length and weight of the toner bottle or the amount of toner contained therein.

The present invention specifies a protruding member formed on the external circumference of a rotating toner bottle of a type able to discharge, through an orifice, toner contained therein, and a contacting part able to move downward when in opposing contact with the passing protruding member, and conversely able to maintain a fixed position when in opposing contact with the protruding member.

This mechanism makes it possible for the contacting part to be depressed downward when in opposing contact with the protruding member, thus allowing the protruding member to pass over the depressed contacting part as means of avoiding the application of vibration to the toner bottle. Conversely, this mechanism also makes it possible for the contacting part to maintain a fixed position when in opposing contact with the protruding member, thus forcing the protruding member to ride up onto and then off of the contacting part as means of applying vibration to the toner bottle.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout several views of the drawings, and wherein.

DETAILED DESCRIPTION OF PREFERRED EMBODIMENTS

An embodiment of the present photocopier invention is explained in the following in reference to the above-described drawings.

Figure 1:
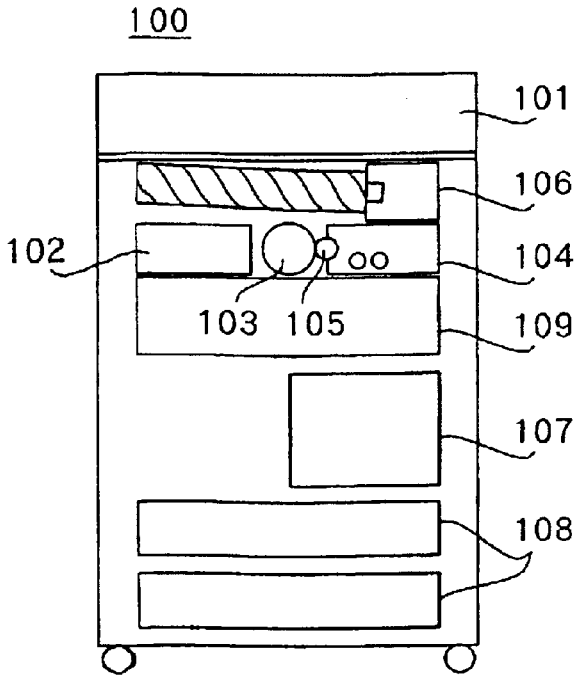
FIG. 1 is an outline view cross section of a photocopier equipped with a toner bottle holding apparatus as prescribed by the invention.

FIG. 1 describes a cross sectioned outline view of an embodiment of photocopier 100.

As illustrated in FIG. 1, the upper portion of photocopier 100 is equipped with document reader 101 for the purpose of reading out documents placed thereon. A laser scanning unit, comprised of a laser generator, polygon mirror and other components, forms an electrostatic image on photosensitive drum 103 based on the image data read out by document reader 101.

Developer unit 104 is installed adjacent to photosensitive drum 103. Photosensitive drum 103 is maintained in contact with developer roller 105 which is installed to developer unit 104. Developer unit 104 is installed beneath toner bottle holding apparatus 106 which includes a toner bottle and toner contained therein, and receives toner supplied by toner bottle holding apparatus 106.

Developer roller 105 applies toner to photosensitive drum 103, on which an electrostatic image has been formed by a laser scanning unit, after which photosensitive drum 103 transfers the adhered toner to the surface of a piece of paper transported from large volume paper cassette 108 or paper cassette 107, both of which are located beneath photosensitive drum 103 within the photocopier 100.

In cases where an image is to be formed on both sides of the transported sheet of paper, a sheet of paper with an image already formed on one side is placed in a dual-side recording unit known as an ADU (auto document unit) identified as component 109. The sheet of paper is turned over within ADU 109 and fed back to the image transfer area where an image is formed on the other side of the sheet. Once the image is transferred to the paper it is fixed at fixing unit 102, then the paper is ejected from photocopier 100.

Figure 2:
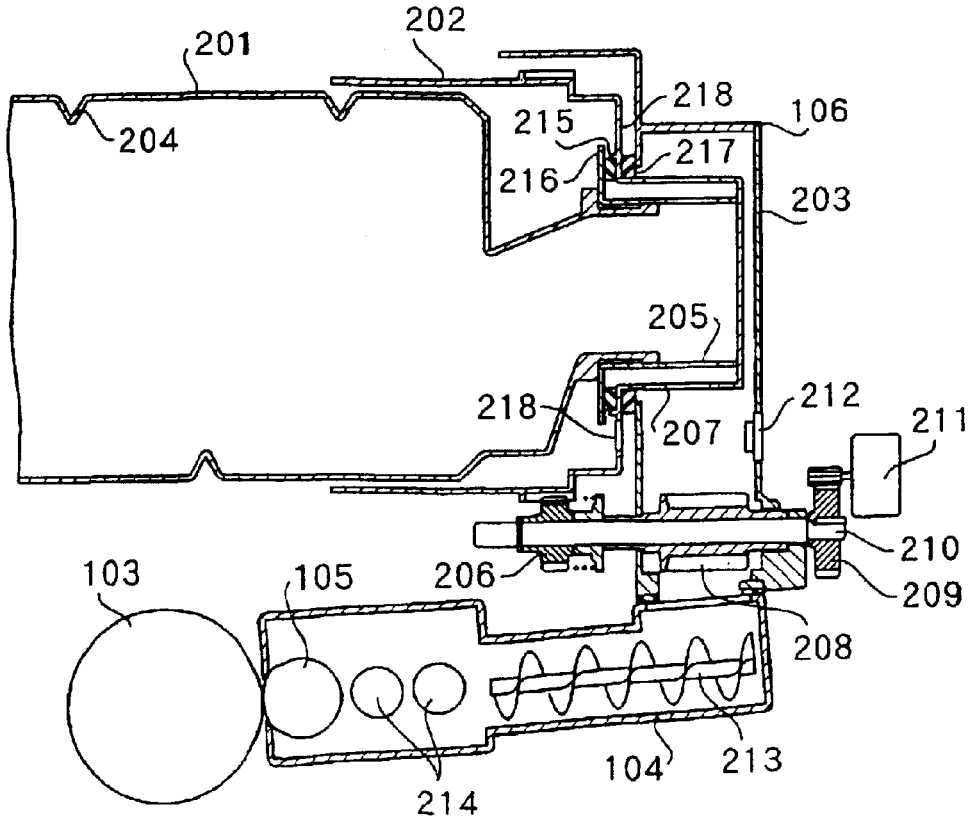
FIG. 2 is an enlarged cross section of the toner bottle holding apparatus installed to a photocopier as prescribed by the invention.

FIG. 2 is an enlarged cross sectional view of toner bottle holding apparatus 106 and the adjacent area. FIG. 2 illustrates toner bottle holding apparatus 106, developer unit 104, and photosensitive drum 103 in a condition in which these components have been removed from the photocopier.

As illustrated in FIG. 2, toner bottle holding apparatus 106 is structured from three components in the form of toner bottle 201, bottle holder 202, and hopper frame 203. Toner bottle 201 is replaced and disposed of when the toner contained therein has been depleted. Toner bottle 201 incorporates spiral rib 204 formed on the internal wall, and extremity orifice 205 through which toner is discharged as a result of the advancing movement of spiral rib 204. The rotation of toner bottle 201 results in the advancing movement of rib 204 that transports and discharges toner to the external region through extremity orifice 205.

Toner bottle 201 is detachably connected to bottle holder 202. A gear formed on the external circumference of bottle holder 202 engages with drive gear 206 which is supported by a supply roller shaft within hopper frame 203, to rotate. Toner bottle 201 rotates concurrently with bottle holder 202 as a result of being joined thereto, thus forming a mechanism through which the toner contained within toner bottle 201 can be transported in the direction of extremity orifice 205.

With toner bottle 201 joined to bottle holder 202, orifice 207 is in a position corresponding to that of extremity orifice 205 of toner bottle 201, thus allowing toner discharged from toner bottle 201 to be supplied to hopper frame 203 by way of orifice 207.

Bottle holder 202 is installed to hopper frame 203. Hopper frame 203 incorporates supply roller 208 which supplies developer unit 104, located at the lower portion of hopper frame 203, with toner, and provides for temporary storage of toner from toner bottle 201 before that toner is supplied to developer unit 104. Supply roller 208 is supported by shaft 210 to which drive gear 209 is attached to one extremity thereon. Motor 211 applies torque to drive gear 209 to rotate supply roller 208.

Drive gear 206, which is supported at the extremity of shaft 210 opposite drive gear 209, engages with a gear provided on the external circumference of bottle holder 202. Drive gear 206 is installed to shaft 210 through a one-way clutch, thereby allowing bottle holder 202 to be rotated when torque is applied in a direction opposite to that of supply roller 208.

Residual toner sensor 212 is installed on a wall of hopper frame 203 as means of monitoring the amount of toner remaining within hopper frame 203. Motor 211 is instructed to rotate bottle holder 202 when sensor 212 detects the point at which the residual toner within hopper fame 203 falls below a specific level. This mechanism thus provides means of maintaining the amount of toner supplied by toner bottle 201 at a uniform volume within hopper frame 203.

Agitation coil 213 and agitation roller 214 are installed to developer unit 104 and operate to both agitate the toner supplied by hopper frame 203 and to transport toner toward developer roller 105. The transported toner adheres to the surface of developer roller 105 which in turn transfers toner to photosensitive drum 103 on which the latent electrostatic image has been formed.

Toner bottle holding apparatus 106 incorporates seals located between toner bottle 201 and bottle holder 202, and between bottle older 202 and hopper frame 203 in order to seal the passage through which toner would otherwise leak to the external environment. Toner bottle holding apparatus 106 also incorporates vent holes to allow the escape of air to the external environment when toner bottle 201 is installed to bottle holder 202.

First seal 215, which is installed between toner bottle 201 and bottle holder 202, seals a passage through which toner discharged from orifice 205 of toner bottle 201 would otherwise leak to the external environment. First seal 215 is located in the vicinity of the front extremity of toner bottle 201, and is sandwiched between flange 216, which is located opposite the facial surface of bottle holder 202, and the facial surface of bottle holder 202.

Second seal 217 is installed between bottle holder 202 and hopper frame 203 as a method of sealing the passage from which toner discharged from orifice 207 of bottle holder 202 would otherwise leak to the external environment. Second seal 217 is sandwiched between facial surfaces of bottle holder 202 and hopper frame 203.

Orifice 218 is provided in the facial surface of bottle holder 202 at a location external to first seal 215 and second seal 217. Orifice 218 provides an escape path to the external environment for air that becomes pressurized within the space formed between bottle holder 202 and hopper frame 203 when toner bottle 201 is joined to bottle holder 202.

In this embodiment, photocopier 100 is equipped with an access cover located on the front of the photocopier that, when opened, allows toner bottle holding apparatus 106 to be pulled outward in order to replace toner bottle 201, or to gain access to the mechanisms located behind toner bottle 201 for maintenance purposes.

Figure 3:
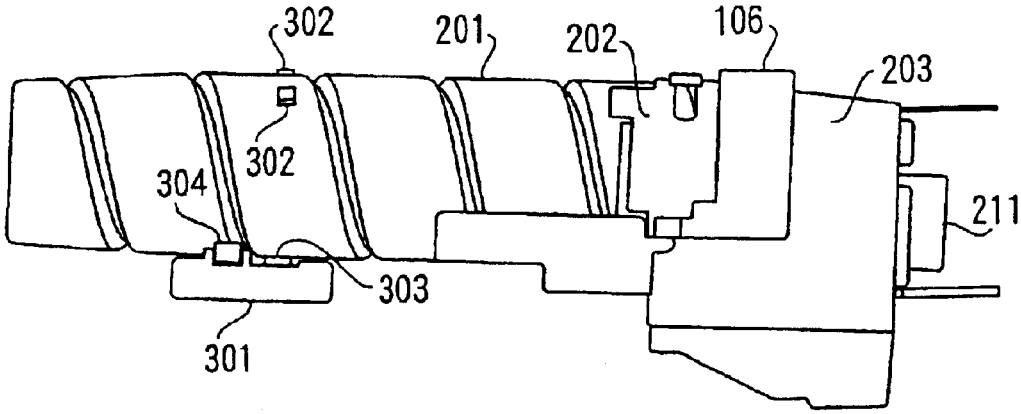
FIG. 3 is a side view of the peripheral region of the toner bottle installed to a photocopier as prescribed by the invention.

FIG. 3 illustrates a side view of the region peripheral to toner bottle 201 mounted to toner bottle holding apparatus 106. FIG. 3 illustrates toner bottle 201 as it exists when fully installed within photocopier 100, that is, when the toner bottle has not been pulled outward from the internal area of photocopier 100.

Figure 4:
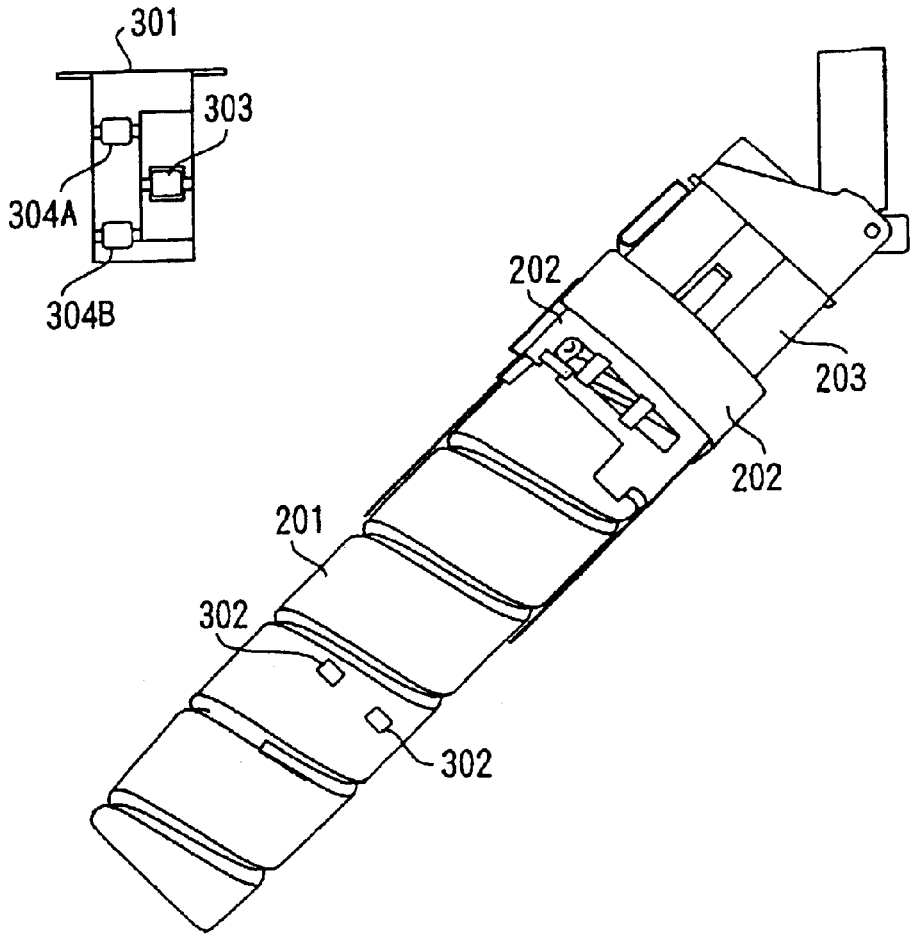
FIG. 4 is a top view of the peripheral region of the toner bottle installed to a photocopier as prescribed by the invention.

FIG. 4 provides a top view of toner bottle 201 and adjacent structures. FIG. 4 illustrates toner bottle 201 in a condition removed from photocopier 100.

FIG. 4 illustrates a structure in which one side of toner bottle holding apparatus 106 is supported by a pivot shaft that allows the left end of toner bottle 201 (the bottom end of the toner bottle as viewed in FIG. 4) to swing out toward the front of photocopier 100, thus allowing removal of toner bottle 201.

With toner bottle 201 installed to photocopier 100 as shown in FIG. 3, support pedestal 301 is provided to support toner bottle 201 at a point slightly to the rear of center.

A protruding member, hereafter referred to as striker block 302, extends outward a small amount from the external circumferential of toner bottle 201 at locations opposite to support pedestal 301. As toner bottle 201 rotates, striker block 302 passes over a specific position of support pedestal 301.

A contacting part, hereafter referred to as contact roller 303, is installed at the upper side of support pedestal 301 at a position that permits opposing contact with striker block 302 of toner bottle 201 as striker block 302 passes. In order to prevent toner from remaining in the toner bottle, contact roller 303 applies vibration to toner bottle 201 by maintaining a fixed position when in opposing contact with striker block 302.

In addition to contact roller 303, idler rollers 304 are provided to maintain contact with the outer circumference of the rearward part of toner bottle 201, and are driven by the rotation of toner bottle 201. Idler rollers 304 provide support at a point toward the rear of toner bottle 201 to prevent the inclination of a toner bottle of greater length and increased weight.

Figure 5:
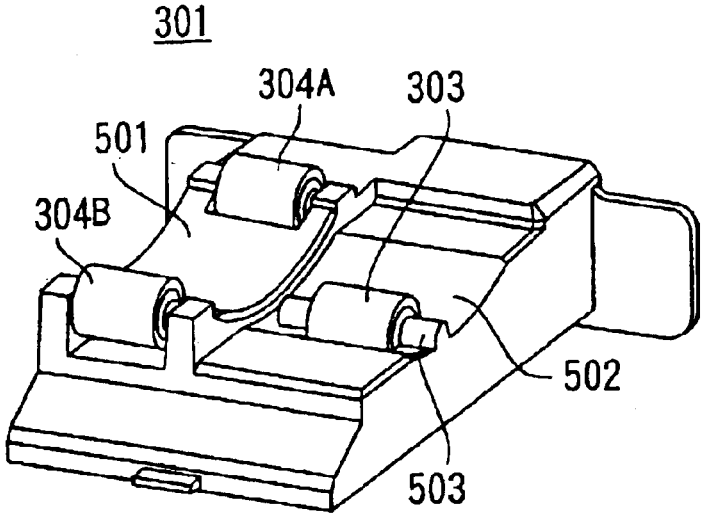
FIG. 5 provides various detail views of the toner bottle support stand equipped to the photocopier as prescribed by the invention.
Figure 5:
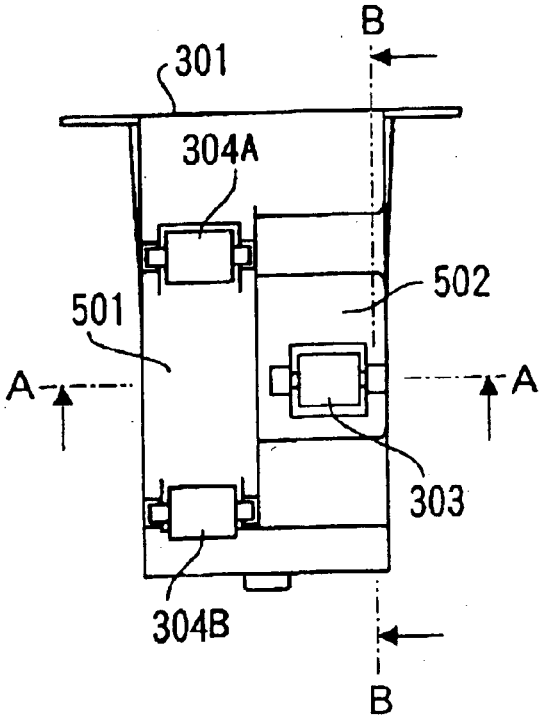
Figure 5:
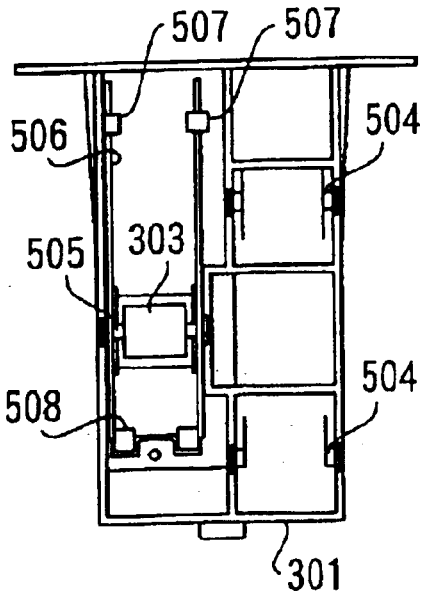

FIG. 5 provides enlarged views of support pedestal 301 that supports toner bottle 201. View 5*a* is a front perspective view, 5*b* is a view from above, and 5*c* is a view of the underside of support pedestal 301.

As shown in FIG. 5*a*, first concave surface 501 is formed on the upper surface of support pedestal 301 in an arc that follows the external contour of toner bottle 201, and is located on the side of support pedestal 301 where idler rollers 304A and 304B are installed.

The shafts on which idler rollers 304A and 304B rotate are supported by support pedestal 301 at the upwardly curving ends of first concave surface 501, and are located so as to allow idler rollers 304A and 304B to extend a small amount above the curved surface.

The external circumference of toner bottle 201 is supported by idler rollers 304A and 304B when toner bottle 201 is installed to photocopier 100. Even in cases where toner bottle 201 is of significant weight, the support provided by idler roller 304A and 304B prevents the downward inclination of the rear portion of toner bottle 201 and the additional load that such inclination would place on the rotation of toner bottle 201. Moreover, the rotational load on toner bottle 201 is further reduced as a result of idler rollers 304A and 304B providing rotational support.

Support pedestal 301 also incorporates second concave surface 502 which is formed at a level lower than that of first concave surface 501. Bearing 503, which is formed within a protruding boss extending upward from concave surface 502, supports a shaft on which contact roller 303 is able to rotate.

Contact roller 303, as illustrated in FIG. 5*b*, is installed adjacent to and directly between idler rollers 304A and 304B. As a result, when toner bottle 201 is supported by support pedestal 301, contact roller 303 is located at a point where it will contact toner bottle 201 directly below the rotational axis of the toner bottle.

As shown in FIG. 5*c*, shafts 504, which support idler rollers 304A and 304B, are secured to the curved concave surface of support pedestal 301. Contact roller shaft 505 is supported from beneath, within bearing 503, by the upper side of spring 506.

As shown in FIG. 5, spring 506 is comprised of bent metal rods. The underside of one end of spring 506 is supported by anchor 507, and the underside of the bent end of spring 506 is supported by anchor 508. Contact roller shaft 505 is supported by the upper side of spring 506.

Figure 6:
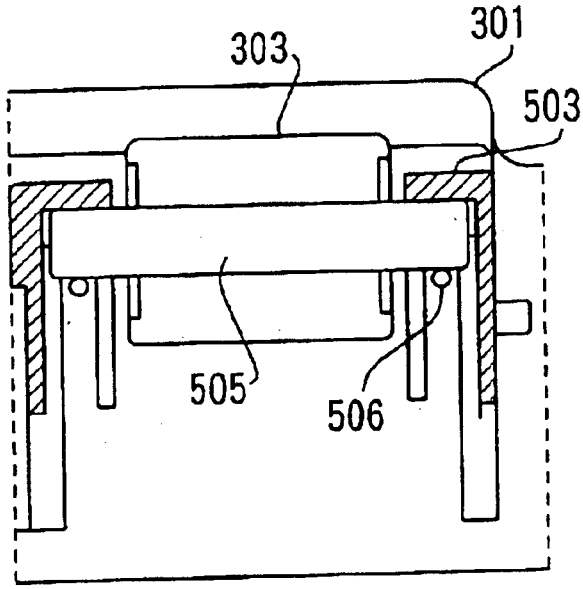
FIG. 6 provides detail cross sections describing the relationship between the roller and spring components of the support stand of the photocopier as prescribed by the invention.
Figure 6:
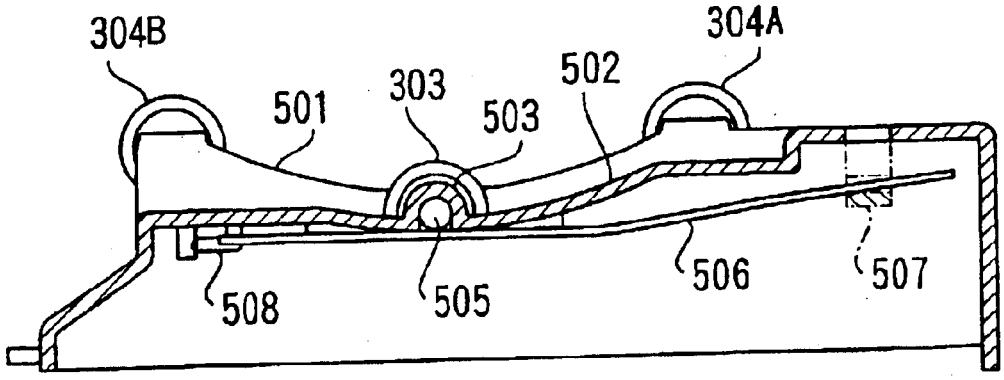

FIG. 6 is a cross sectional view of the structure comprised of contact roller 303, contact roller shaft 505, and spring 506. FIG. 6*a* is a cross sectional view taken from broken line 'A' in the direction of the arrows shown in FIG. 5*b*, and FIG. 6*b* is a cross sectional view taken from broken line 'B' in the direction of the arrows shown in FIG. 5*b*. The cross sectioned surfaces in FIG. 6 are indicated by the crosshatched lines.

As illustrated in both FIG. 6 views, contact roller shaft 505 is supported from below by spring 506, and is held up in the pocket of bearing 503 through pressure applied by spring 506. Maintained in this position, contact roller 303 extends outward from second concave surface 502 as can be seen in FIG. 5*a*.

When pressure is applied in a direction against the upward pressure of spring 506, that applied pressure is transferred to spring 506 through contact roller shaft 505, thus causing spring 506 to flex in the downward direction. This downward flex results in contact roller shaft 505 moving downward into support pedestal 301 along with contact roller 303.

The strength of spring 506 is established at a level that prevents contact roller 303 from falling downward into support pedestal 301 at the time when striker block 302 is in opposing contact with contact roller 303 when the weight of toner bottle 201, that is, the weight of the toner within toner bottle 201, falls below a predetermined weight.

Figure 7:
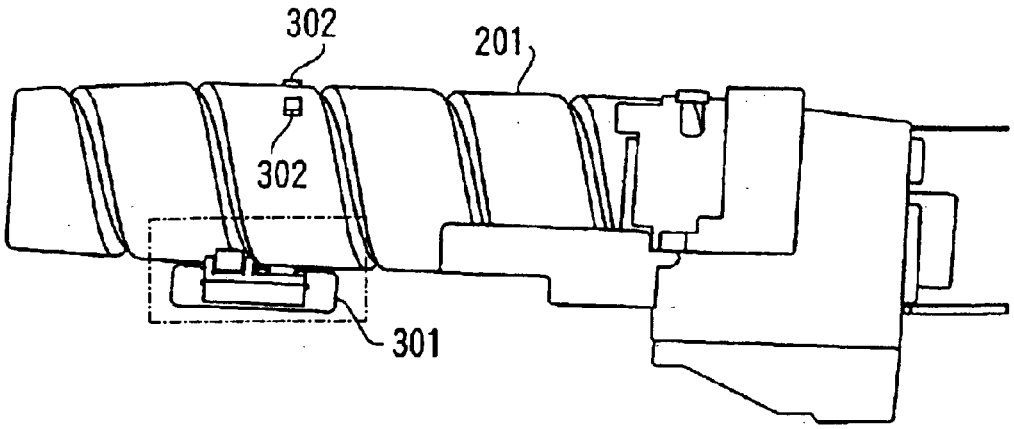
FIGS. 7(A) and 7(B) are side views of the peripheral region of the toner bottle installed to the photocopier as prescribed by the invention.
Figure 7:
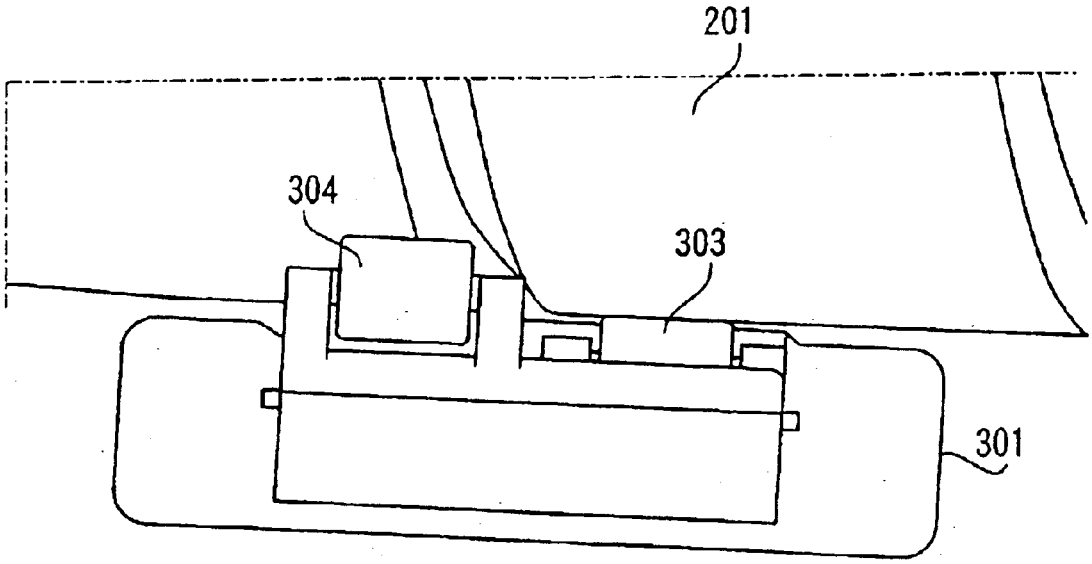
Figure 8:
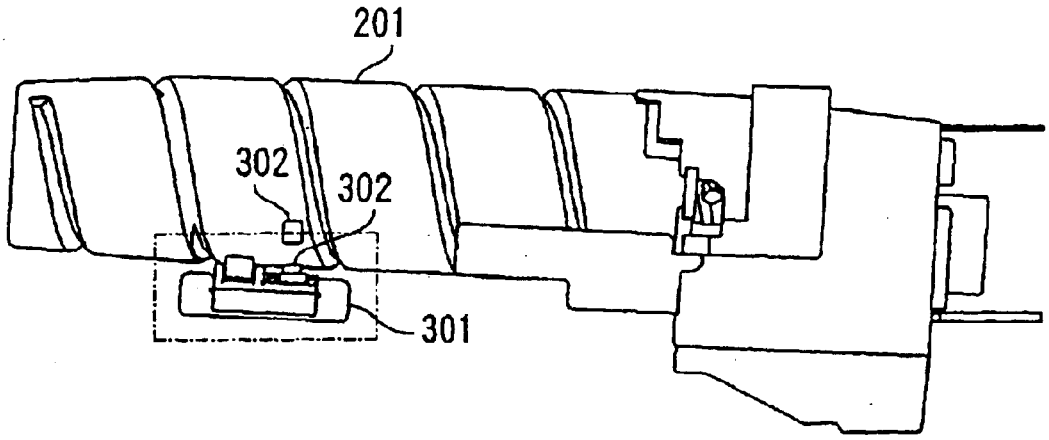
FIGS. 8(A) and 8(B) are side views of the peripheral region of the toner bottle installed to the photocopier as prescribed by the invention.
Figure 8:
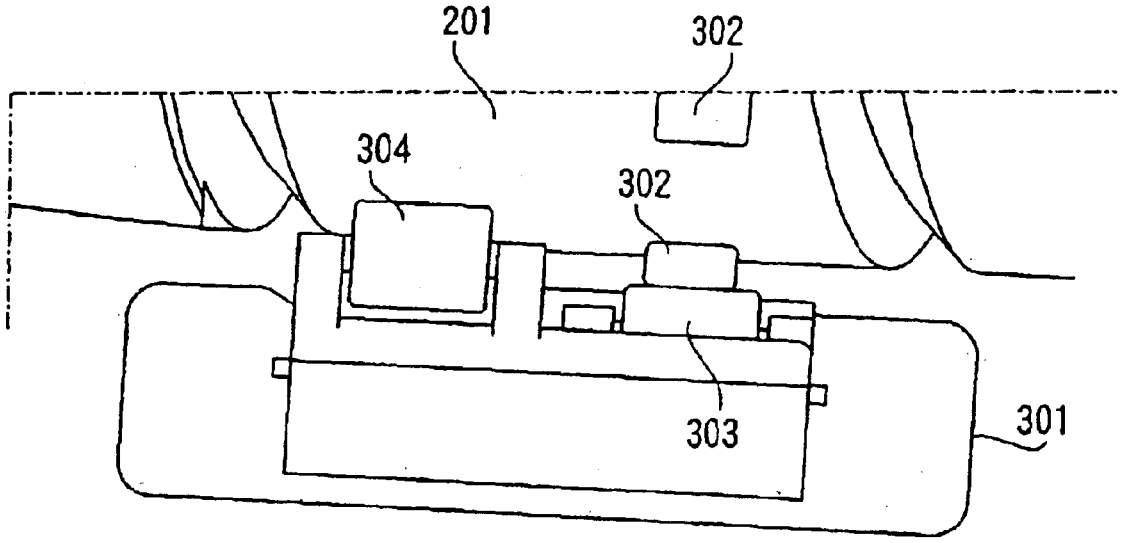

The following describes the movement of toner bottle 201 in regard to photocopier 100. FIGS. 7*a* and 8*a* are side views of toner bottle 201 and the adjacent areas. FIGS. 7*b* and 8*b* are enlarged side views of support pedestal 301 and adjacent areas corresponding to FIGS. 7*a* and 8*a*. FIGS. 7 and 8 illustrate a condition in which the weight of toner bottle 201 is less than the predetermined weight that would otherwise press contact roller 303 downward.[1]

As shown in FIG. 7*a*, when striker block 302 is not in the vicinity of support pedestal 301, toner bottle 201 is supported by contact roller 303 as well as idler rollers 304A and 304B.

At this time, contact roller 303 rotates against the external surface of toner bottle 201, and as shown in FIG. 7*b*, supports the rotation of toner bottle 201 in the same manner as idler rollers 304.

When striker block 302 comes into the vicinity of support pedestal 301, as shown in FIG. 8*a*, contact roller 303 does not move downward as a result of coming into opposing contact with striker block 302. Instead, striker block 302 rides up and over contact roller 303 as a result of the weight of toner bottle 201 being below the predetermined weight that would otherwise press contact roller 303 downward. This mechanism results in toner bottle 201 rising only a distance equal to the thickness of striker block 302.

Striker block 302 rides up onto contact roller 303 after which toner bottle 201 drops a distance equal to the thickness of striker block 302, thus allowing the external circumference of toner bottle 201 to again come into opposing contact with and be supported by contact roller 303 as well as idler rollers 304A and 304B.

This type of vertical agitation of toner bottle 201 applies a specific vibration capable of breaking up lumps of toner within toner bottle 201, thus preventing toner from agglutinating within bottle 201 and aiding toner transport therein.

Figure 9:
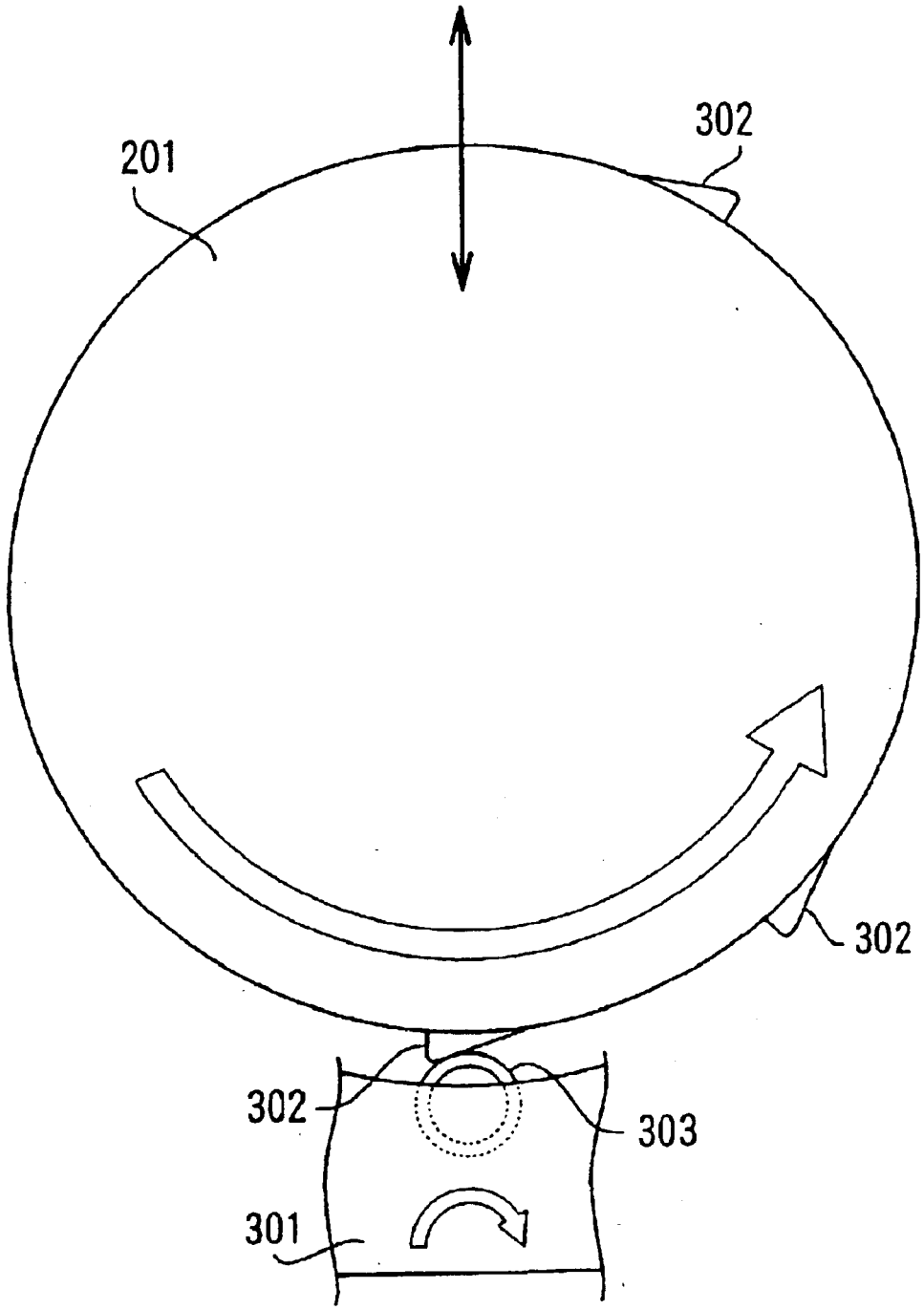
FIG. 9 is a radial cross section of the toner bottle installed to the photocopier as prescribed by the invention.

FIG. 9 is a cross sectional view of toner bottle 201 at the position where contact roller 303 is in opposing contact with striker block 302. As FIG. 9 illustrates, contact roller 303 is located directly beneath the rotating axis of toner bottle 201 with the toner bottle supported by support pedestal 301. As a result, it becomes possible for contact roller 303 to apply vibration to toner bottle 201 in a specific vertical direction.

Accordingly, the space within which toner bottle 201 is agitated, as resulting from the applied vibration, can be maintained on a fixed axis in order to minimize the space that must be provided for agitation.

The following will explain the movement of contact roller 303 in relation to the weight of toner bottle 201. FIGS. 10*a* and 11*a* are cross sectional views of toner bottle 201 and the adjacent area. FIGS. 10*b* and 11*b* are enlarged views of support pedestal 301 and the adjacent area.

Figure 10:
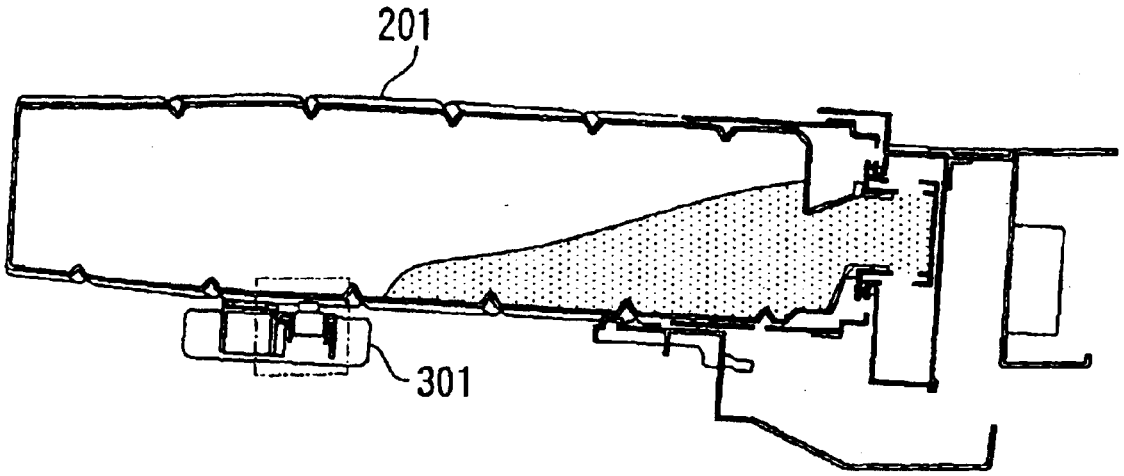
FIGS. 10(A) and 10(B) are side views cross section of the peripheral region of the toner bottle installed to the photocopier as prescribed by the invention.
Figure 10:
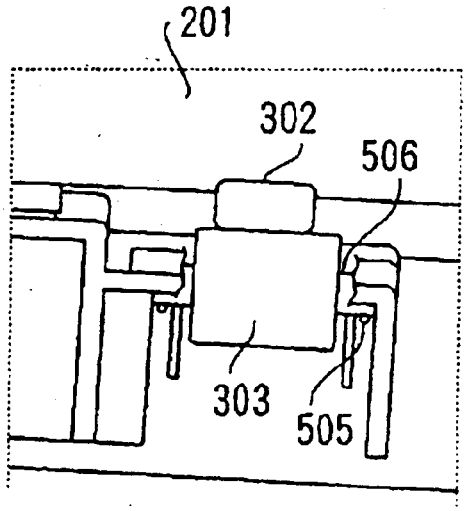
Figure 11:
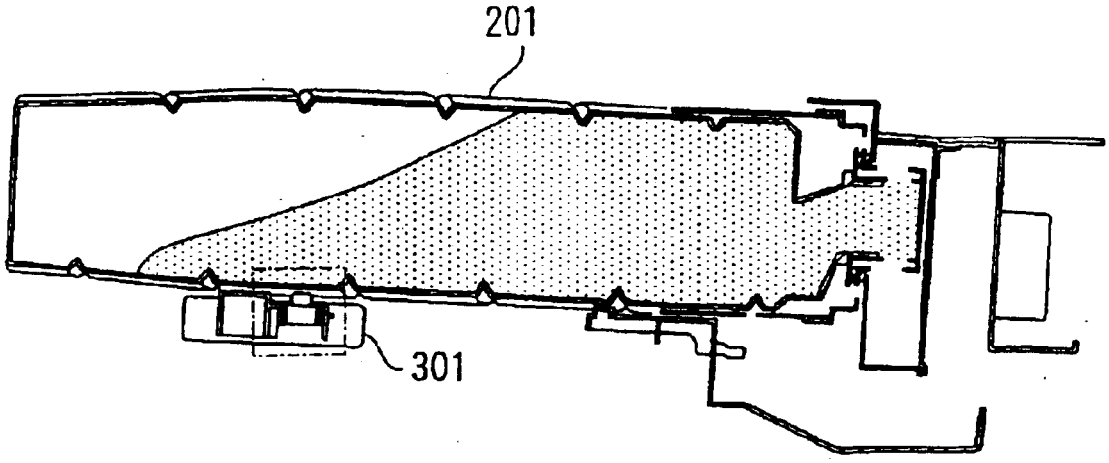
FIGS. 11(A) and 11(B) are side views cross section of the peripheral region of the toner bottle installed to the photocopier as prescribed by the invention.
Figure 11:
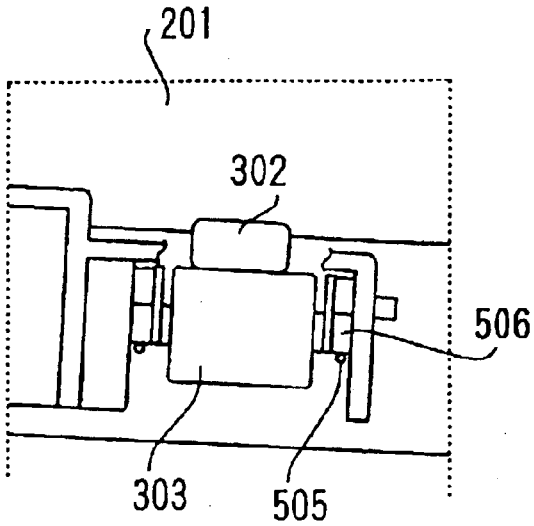
Figure 12:
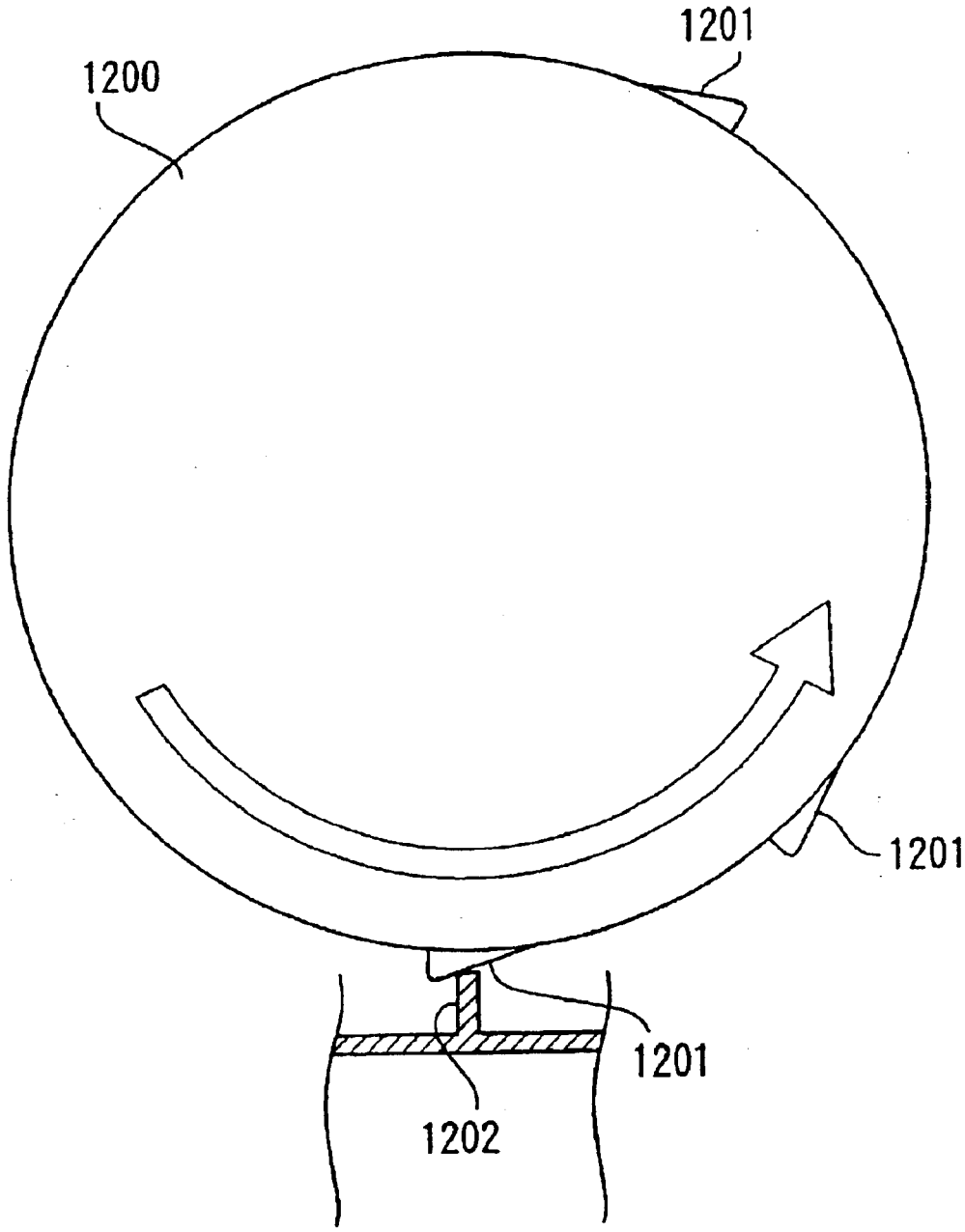
FIG. 12 is a radial cross section view of a toner bottle installed to a conventional photocopier.

FIG. 10 illustrates a condition in which the weight of toner bottle 201 is below the predetermined weight, and FIG. 11 illustrates a condition in which the weight of toner bottle 201 exceeds that predetermined weight.

FIG. 10 illustrates, as previously explained by the descriptions relating to FIG. 7, that contact roller 303 is able to maintain a fixed position when in opposing contact with striker block 302 as a result of the weight of toner bottle 201 being less than the predetermined weight. As a result, striker block 302 rides up and onto, and then falls off of contact roller 303, thus providing a mechanism through which a specific vibration can be applied to toner bottle 201.

In other words, when the weight of toner bottle 201 decreases below the predetermined weight as shown in FIG. 10*b*, the downward pressure on contact roller 303 is not able to overcome the upward pressure applied by spring 506. As a result, spring 506 is able to maintain the position of contact roller shaft 505 in bearing 503, thus preventing contact roller 303 from moving downward into support pedestal 301.

Conversely, when the weight of toner bottle 201 is greater than the predetermined weight, the pressure applied to contact roller 303 by striker block 302 is sufficient to press contact roller 303 downward into support pedestal 301. When the weight of toner bottle 201 is greater than the predetermined weight, no vibration is applied to toner bottle 201 because contact roller 303 retracts upon opposing contact with striker block 302.

In other words, when the weight of toner bottle 201 is greater than the predetermined weight, as shown in FIG. 11*b*, the pressure applied in the downward direction through contact roller 303 overcomes the upward pressure of spring 506. Spring 506 thus moves downward, thereby causing roller 303 to fall downward into the internal area of support pedestal 301.

Photocopier 100, as structured in this embodiment, incorporates striker block 302 formed on the external circumference of toner bottle 201, and contact roller 303 that moves downward when in opposing contact with passing striker block 302. Under specific conditions however, contact roller 303 is also able to maintain a fixed position when in opposing contact with striker block 302.

In a case where contact roller 303 moves downward as a result of opposing contact with striker block 302, striker block 302 rides over depressed contact roller 303 as means of avoiding the application of vibration to toner bottle 201. As a result, the displacement of toner bottle 201 from the rotating axis is reduced and the load on the motor is significantly decreased, thus minimizing the possibility of drive system malfunction.

Conversely, contact roller 303 is also able to maintain a fixed position when in opposing contact with striker block 302, thus forcing striker block 302 to ride up onto and then fall off of contact roller 303 as means of applying vibration to toner bottle 201. This mechanism aids the transport of toner within toner bottle 201 and prevents toner from remaining therein.

This embodiment describes a structure in which the part that comes into opposing contact with striker block 302 is provided in the form of striker roller 303. The use of a roller mechanism eliminates friction against striker block 302, thus allowing appropriate vibration to be applied to toner bottle 201 in a way that does not interfere with the rotation of toner bottle 202.

Moreover, contact roller shaft 505 is supported by upper side of spring 506 which allows contact roller 303 to simply move downward when in opposing contact with striker block 302, thus providing for a contacting part of simple structure.

Furthermore, the strength of spring 506, which is located beneath contact roller 303, is established at a level that prevents contact roller 303 from moving downward into support pedestal 301 when in opposing contact with striker block 302 at a time when the weight of toner bottle 201 is less than a predetermined weight.

When there is a large amount of toner contained within toner bottle 201, a sufficient amount of toner will discharge from the extremity orifice of the toner bottle without the application of vibration. The application of vibration to toner bottle 201 at this time would place an additional and unnecessary load on the motor. Conversely, if vibration is not applied to toner bottle 201 when there is a small amount of toner contained therein, an insufficient amount of toner will be discharged from the extremity orifice. The application of vibration to toner bottle 201 at this time will result in only a minimal load being placed on the motor.

In this embodiment, the strength of spring 506 is set at a level capable of maintaining contact roller 303 in fixed position in opposition to striker block 302 when the weight of toner bottle 201 is less than the predetermined weight. Accordingly, when toner bottle 201 is heavier as a result of a large amount of toner contained therein, contact roller 303 will be pressed downward when in opposing contact with striker block 302, thereby avoiding the application of vibration to toner bottle 201 when vibration is not required to insure a sufficient toner supply, and thereby preventing an additional load from being placed on the motor.

Conversely, when there is a small amount of toner within toner bottle 201, contact roller 303 will not be depressed by opposing contact with striker block 302, thereby allowing a vibration to be applied toner bottle 201 as means of maintaining sufficient toner replenishment. Because the weight of toner bottle 301 is relatively light at this time as a result of the reduced amount of toner, there is little additional load placed on the motor.

Furthermore, while this embodiment has been described in the form of photocopier 100, it is by no means limited to this specific use and may be embodied in other types of devices that offer a computer printing function, copying function, facsimile function, or a combination of two or more of these functions. The printing function is the function for printing image data which is transmitted from the PC connected to the apparatus. The copying function is the function for printing image data obtained by the scanner. The facsimile function is the function for printing image data received from a calling facsimile via a communication network, and for transmitting image data scanned by the scanner, via the communication network. A machine which is provided with two functions among these functions is named as a multifunction printer.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

This application is based on the Japanese Patent Application No. 2002-041384 filed on Feb. 19, 2002, entire content of which is expressly incorporated by reference herein.

What is claimed is:

1. A photocopier comprising:

a toner bottle that discharges toner from an opening by a rotation, said toner bottle having a protrusion;

a motor that rotates said toner bottle; and a contacting section provided at a position through which the protrusion passes when the protrusion comes down by the rotation of said toner bottle, said contacting section being movable;

wherein when the weight of said toner bottle is more than or equal to a predetermined value, said contacting section descends by the weight of said toner bottle when the protrusion passes through said contacting section, and said contacting section ascends when the protrusion passes away from said contacting section, wherein when the weight of said toner bottle is less than a predetermined value, said contacting section doesn't descend by the weight of said toner bottle but the protrusion rises up onto said contacting section to apply vibration to said toner bottle when the protrusion passes through said contacting section.

2. The photocopier according claim 1, wherein said contacting section is provided under a center of the rotation of said toner bottle.

3. The photocopier according claim 1, wherein said contacting section comprises a roller.

4. The photocopier according to claim 3, wherein an axis of said roller is energized upward by a spring.

5. The photocopier according to claim 4, wherein a power of the spring is adjusted so that said contacting section doesn't descend when the weight of said toner bottle is less than the predetermined value and said contacting section contacts the protrusion.

6. A multifunction printer connected to a remote terminal to print image data from the remote terminal, the printer comprising:

a scanner configured to scan a document to obtain image data;

a printer configured to print the image data obtained by said scanner, and print the image data from the remote terminal;

a toner bottle that discharges toner from an opening by a rotation, said toner bottle having a protrusion;

a motor that rotates said toner bottle; and a contacting section provided at a position through which the protrusion passes when the protrusion comes down by the rotation of said toner bottle, said contacting section being movable;

wherein when the weight of said toner bottle is more than or equal to a predetermined value, said contacting section descends by the weight of said toner bottle when the protrusion passes through said contacting section, and said contacting section ascends when the protrusion passes away from said contacting section, wherein when the weight of said toner bottle is less than a predetermined value, said contacting section doesn't descend by the weight of said toner bottle but the protrusion rises up onto said contacting section to apply vibration to said toner bottle when the protrusion passes through said contacting section.

* * * * *